US009909746B2

(12) United States Patent
Kawachi et al.

(10) Patent No.: US 9,909,746 B2
(45) Date of Patent: Mar. 6, 2018

(54) ILLUMINATION DEVICE

(71) Applicant: PANASONIC INTELLECTUAL PROPERTY MANAGEMENT CO., LTD., Osaka (JP)

(72) Inventors: Hideharu Kawachi, Hyogo (JP); Shinichi Anami, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 16 days.

(21) Appl. No.: 15/180,302

(22) Filed: Jun. 13, 2016

(65) Prior Publication Data

US 2016/0377270 A1 Dec. 29, 2016

(30) Foreign Application Priority Data

Jun. 26, 2015 (JP) ..... 2015-128448

(51) Int. Cl.

| | |
|---|---|
| ***F21V 21/34*** | (2006.01) |
| ***F21V 7/00*** | (2006.01) |
| ***F21V 9/16*** | (2006.01) |
| ***F21V 13/14*** | (2006.01) |
| ***F21V 14/04*** | (2006.01) |
| *F21W 131/405* | (2006.01) |
| *F21Y 101/00* | (2016.01) |

(52) U.S. Cl.

CPC ..... *F21V 21/34* (2013.01); *F21V 7/0033* (2013.01); *F21V 9/16* (2013.01); *F21V 13/14* (2013.01); *F21V 14/04* (2013.01); *F21W 2131/405* (2013.01); *F21Y 2101/00* (2013.01)

(58) Field of Classification Search

None

See application file for complete search history.

(56) References Cited

U.S. PATENT DOCUMENTS

| | | | | |
|---|---|---|---|---|
| 2011/0085319 | A1 | 4/2011 | Hikmet | |
| 2011/0148280 | A1 | 6/2011 | Kishimoto et al. | |
| 2012/0051377 | A1* | 3/2012 | Liang | H01S 5/0092 372/36 |
| 2016/0033098 | A1* | 2/2016 | Bergman | H02G 3/20 362/418 |

FOREIGN PATENT DOCUMENTS

| | | |
|---|---|---|
| JP | H06-130526 | 5/1994 |
| JP | 2001-184934 | 7/2001 |
| JP | 2004-113175 | 4/2004 |
| JP | 2011-129374 | 6/2011 |
| JP | 2011-526060 | 9/2011 |
| JP | 2013-080638 | 5/2013 |
| JP | 2014-175126 | 9/2014 |

* cited by examiner

*Primary Examiner* — Kristy A Haupt

(74) *Attorney, Agent, or Firm* — Greenblum & Bernstein, P.L.C.

(57) ABSTRACT

An illumination device includes a light source configured to emit laser light, a transmission part configured to transmit the laser light emitted from the light source, and a lighting appliance configured to convert a wavelength of the laser light transmitted through the transmission part and to emit illumination light. The transmission part includes a rail-shaped guide part extending in a linear shape along a transmission direction of the laser light. The lighting appliance is configured to be mounted in an arbitrary position of the guide part.

7 Claims, 5 Drawing Sheets

ILLUMINATION DEVICE

CROSS-REFERENCE TO RELATED APPLICATIONS

This application claims priority to Japanese Patent Application No. 2015-128448, filed Jun. 26, 2015, the entire contents of which are hereby incorporated by reference.

TECHNICAL FIELD

The disclosure relates to an illumination device which uses a light source for emitting laser light.

BACKGROUND ART

Conventionally, a spotlight type illumination device is used in a show window or a museum to illuminate an object. In this illumination device, an LED or the like capable of emitting light at high efficiency has been extensively used. In recent years, there is known an illumination device which uses, as a light source, a semiconductor laser capable of emitting light at higher efficiency and higher output power than the LED (see, e.g., Japanese Unexamined Patent Application Publication No. 2014-175126 (JP2014-175126A)).

The illumination device disclosed in JP2014-175126A includes a light source configured to emit laser light and a plurality of light emitting units. Each of the light emitting units includes a linear light guide body having an incidence surface on which the laser light emitted from the light source is incident and an emission surface from which the incident laser light is emitted. The light source and each of the light emitting units are connected by an optical fiber. The laser light emitted from the light source is transmitted to each of the light emitting units through the optical fiber. Furthermore, the respective light emitting units are configured such that they can be disposed in a linear shape, a curve line shape or a bend line shape on a unit-by-unit basis.

Meanwhile, there is a spotlight type illumination device in which the installation position of a lighting appliance can be arbitrarily selected depending on the arrangement of an object to be irradiated with illumination light. However, in the illumination device disclosed in JP2014-175126A, the position of each of the light emitting units (lighting appliances) is fixed with respect to the light source for emitting laser light. It is therefore impossible to arbitrarily select the installation positions of the light emitting units depending on the use environment of the illumination device.

SUMMARY OF THE INVENTION

In view of the above, the present disclosure provides an illumination device capable of arbitrarily selecting the installation position of a lighting appliance which emits illumination light using a light source emitting laser light.

In accordance with an aspect, there is provided an illumination device, including: a light source configured to emit laser light; a transmission part configured to transmit the laser light emitted from the light source; and a lighting appliance configured to convert a wavelength of the laser light transmitted through the transmission part and to emit illumination light, wherein the transmission part includes a rail-shaped guide part extending in a linear shape along a transmission direction of the laser light, and the lighting appliance is configured to be mounted in an arbitrary position of the guide part.

According to the illumination device configured as above, the lighting appliance can be mounted in an arbitrary position of the rail-shaped guide part linearly extending along a transmission direction of laser light. This enables a user or other person to arbitrarily select the installation position of the lighting appliance which emits illumination light.

BRIEF DESCRIPTION OF THE DRAWINGS

The figures depict one or more implementations in accordance with the present teaching, by way of example only, not by way of limitations. In the figures, like reference numerals refer to the same or similar elements.

DETAILED DESCRIPTION

Figure 1A:
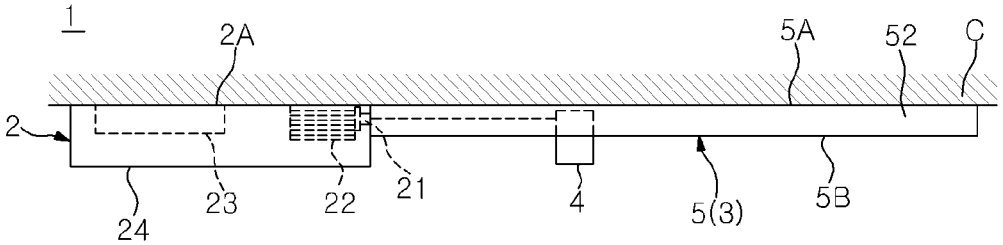
FIG. 1A is a side view showing a configuration of an illumination device according to one embodiment.
Figure 1B:
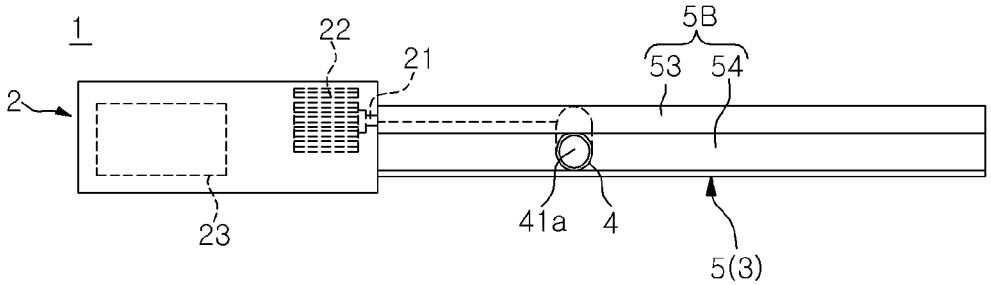
FIG. 1B is a front view thereof.

An illumination device according to one embodiment will be described with reference to FIGS. 1A to 5. As illustrated in FIGS. 1A and 1B, the illumination device 1 of the present embodiment is installed on an installation surface C of a ceiling or the like and is configured to irradiate illumination light primarily in a direction perpendicular to the installation surface C. The illumination device 1 includes a light source 2 configured to emit laser light, a transmission part 3 configured to transmit the laser light emitted from the light source 2, and a lighting appliance 4 configured to convert a wavelength of the laser light transmitted through the transmission part 3 and to irradiate illumination light.

The transmission part 3 includes a rail-shaped guide part 5 which extends in an elongated shape along a transmission direction of the laser light. The light source 2 and the guide part 5 include installation surfaces 2A and 5A through which the light source 2 and the guide part 5 are fixed on the installation surface C, respectively. Furthermore, the guide part 5 includes a mounting surface 5B at the opposite side of the installation surface 5A and the lighting appliance 4 is mounted thereon.

The light source 2 includes a semiconductor laser element 21, a heat dissipation part 22 for dissipating heat generated during the operation of the semiconductor laser element 21, a lighting control circuit 23 for lighting the semiconductor laser element 21, and a light source case 24 for accommodating the semiconductor laser element 21, the heat dissipation part 22 and the lighting control circuit 23. In the subject specification, the lighting control circuit 23 is described as one component of the light source 2, which is accommodated within the light source case 24. As an alternative example, the lighting control circuit 23 may be an independent component provided outside the light source case 24.

A laser element configured to emit blue light having a wavelength of, for example, 440 nm to 455 nm, is used as the semiconductor laser element 21. A lens (not shown) for converting the emitted laser light to substantially parallel light is provided in an emission portion of the semiconductor laser element 21. The heat dissipation part 22 is made of a metal having high heat dissipation, such as an aluminum alloy or the like. A general-purpose die-cast member provided with fins for improving heat dissipation is used as the heat dissipation part 22. The lighting control circuit 23 includes a rectifier transformer circuit (not shown) which converts an electric current received from a commercial power source (not shown) to a predetermined direct current and controls a voltage applied to control the output of the semiconductor laser element 21 so as to correspond to a predetermined output control signal. The light source case 24 is a box-shaped structure made of, for example, stainless steel or the like. A guide part 5 is connected to one surface of the light source case 24.

Figure 2:
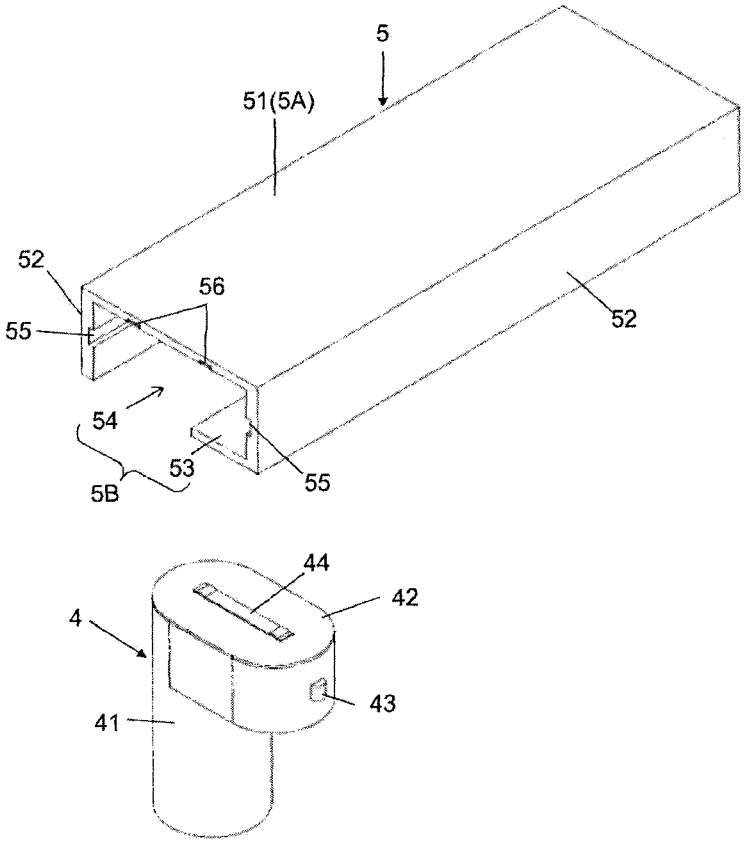
FIG. 2 is a perspective view of a guide part and a lighting appliance used in the illumination device.

As illustrated in FIG. 2, the rail-shaped guide part 5 includes a flat bottom wall 51 extending in the longitudinal direction of the guide part 5 to define the installation surface 5A and opposite side walls 52 formed at the opposite edges of the bottom wall 51. Furthermore, the guide part 5 includes a mounting surface 5B extending substantially parallel to the installation surface 5A. The mounting surface 5B includes a cover portion 53 configured to surround a space through which the laser light emitted from the light source 2 is transmitted in the air and an opening portion 54 formed at a predetermined width along the cover portion 53. The lighting appliance 4 is fitted to the opening portion 54 and is mounted to the guide part 5 in the below-described order.

Engagement grooves 55, in which the below-described projection portions 43 of the lighting appliance 4 are engaged, are formed on the inner surfaces of the side walls 52 of the guide part 5 over the total length of the guide part 5. Furthermore, a pair of electrodes 56 is formed on the surface of the bottom wall 51 facing toward the mounting surface 5B over the total length of the guide part 5 (see FIGS. 4A and 4B). The electrodes 56 are connected to the lighting control circuit 23 of the light source 2, which is not illustrated.

The lighting appliance 4 includes a cylindrical lighting appliance case 41, a mounting portion 42 for mounting the lighting appliance 4 to the guide part 5, and projection portions 43 provided in the mounting portion 42 and engaged in the engagement grooves 55 of the guide part 5. The lighting appliance case 41 has an internal space for accommodating the below-described wavelength conversion part 48 and the like. Furthermore, the lighting appliance case 41 is provided on its bottom surface with an opening 41*a* from which illumination light is emitted (see FIG. 1B).

The mounting portion 42 is a cylindrical structural member having two mutually-orthogonal sides differing in length from each other when viewed in the direction perpendicular to the mounting surface 5B and having a cross section of a transversely-elongated elliptical shape. The mounting portion 42 is provided so as to transversely protrude from the top end of the lighting appliance case 41. The interior of the mounting portion 42 communicates with the internal space of the lighting appliance case 41. Furthermore, the shorter side length L1 of the mounting portion 42 corresponds to the width W1 of the opening portion 54, and the longer side length L2 of the mounting portion 42 corresponds to the internal width W2 of the guide part 5 (see FIG. 3B which will be described later). Moreover, the lighting appliance 4 includes a leaf spring 44 provided on the top surface of the lighting appliance case 41 and configured to short-circuit the electrodes of the guide part 5 when the lighting appliance 4 is mounted to the guide part 5. The leaf spring 44 is formed of an electrically conductive member.

Figure 3A:
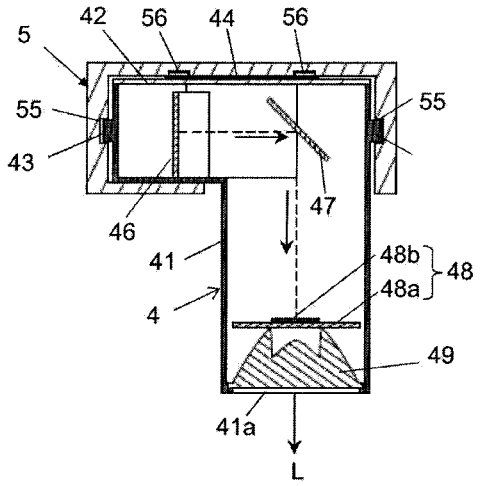
FIG. 3A is a sectional view orthogonal to the longitudinal direction of the guide part, showing side cross-sections of the lighting appliance and the guide part used in the illumination device.
Figure 3B:
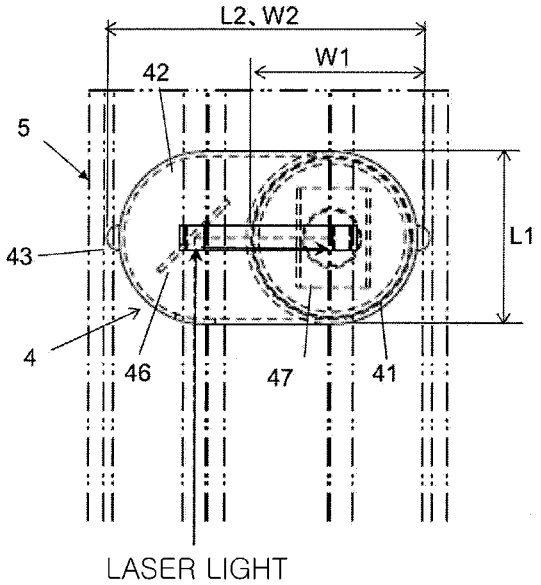
FIG. 3B is a partial perspective top view thereof.
Figure 4A:
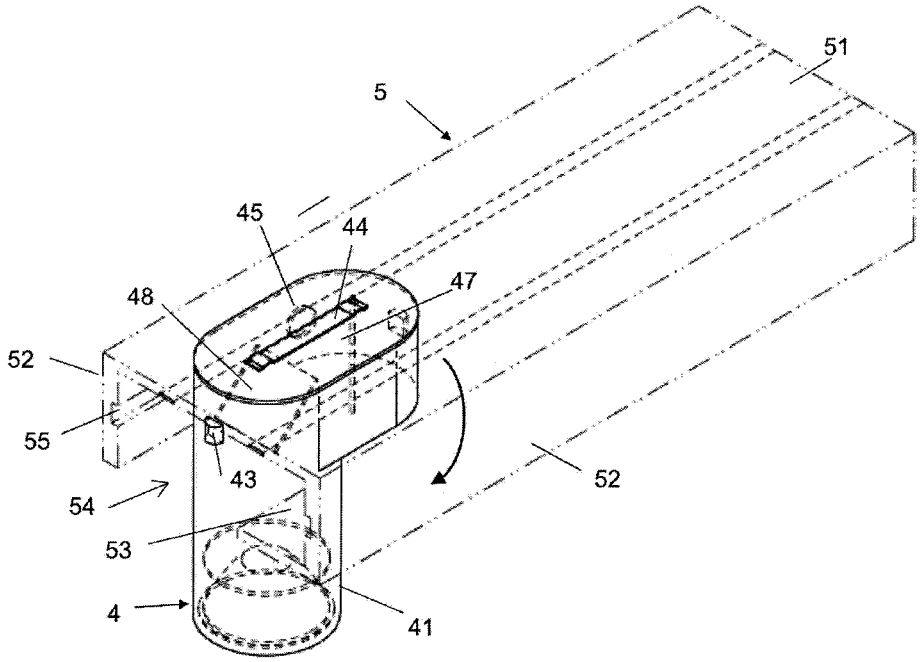
FIGS. 4A and 4B are perspective views for explaining the procedure of mounting the lighting appliance used in the illumination device to the guide part.
Figure 4B:
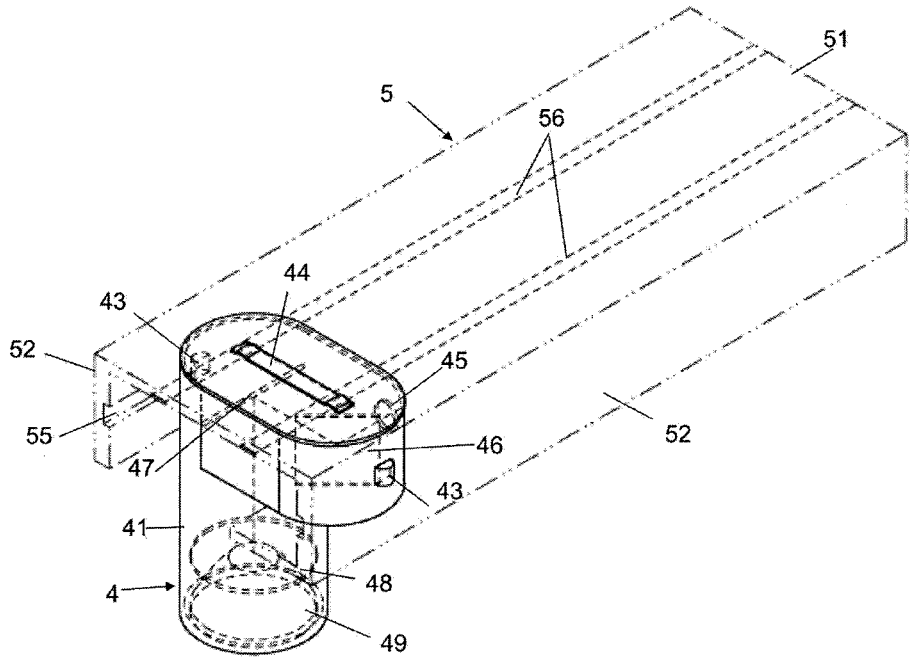

The mounting portion 42 has a hole portion 45 formed on a longer side surface and configured to introduce the transmitted laser light into the lighting appliance 4 via the space surrounded by the cover portion 53 (see FIGS. 4A and 4B). As illustrated in FIGS. 3A and 3B, the lighting appliance 4 further includes a first reflection portion 46 configured to reflect the laser light introduced through the hole portion 45 in the width direction of the guide part 5 and a second reflection portion 47 configured to reflect the laser light reflected by the first reflection portion 46 in the direction perpendicular to the mounting surface 5B. The first reflection portion 46 and the second reflection portion 47 are respectively fixed to the mounting portion 42 and the interior of the lighting appliance case 41 at an angle inclined with respect to the transmission direction of the laser light so as to reflect the laser light at an angle of 90 degrees.

The lighting appliance 4 further includes a wavelength conversion part 48 configured to convert a wavelength of the laser light reflected by the second reflection portion 47 and to emit the wavelength-converted laser light as illumination light, and an optical member 49 configured to control distribution of the light emitted from the wavelength conversion part 48 and to generate substantially parallel light.

The wavelength conversion part 48 is formed of a phosphor plate which includes a phosphor configured to convert the wavelength of the laser light emitted from the light source 2 and to emit the wavelength-converted laser light. The wavelength conversion part 48 includes a substrate 48*a* and a phosphor 48*b* formed on the substrate 48*a* in a film shape. For example, a crystalline substrate made of glass, quartz, sapphire or the like or a sintered substrate made of spinel or the like may be used as the substrate 48*a*. Since the material such as quartz, sapphire or the like is high in heat conductivity and superior in heat dissipation, it is particularly preferable to use the material such as quartz, sapphire or the like. For example, a yellow phosphor excited by blue laser light to emit yellow light may be used as the phosphor 48*b*. The wavelength conversion part 48 is configured to emit white illumination light obtained by mixing the blue laser light transmitted from the light source 2 and the yellow light generated by the light emission of the phosphor.

As illustrated in FIG. 4A, the guide part 5 of the illumination device 1 is fixed to the installation surface C (see FIG. 1) in advance. The lighting appliance 4 is inserted into the opening portion 54 of the guide part 5 in a state that the long side of the mounting portion 42 extends in the longitudinal direction of the guide part 5. A user or other person rotates the lighting appliance 4 by 90 degrees in a state in which the upper surface of the lighting appliance 4 reaches the bottom wall 51 of the guide part 5. Then, as illustrated in FIG. 4B, the mounting portion 42 laterally protruding from the lighting appliance case 41 comes into a region surrounded by the cover portion 53. The projection portions 43 provided at the opposite ends of the mounting portion 42 are respectively fitted in the engagement grooves 55 of the guide part 5. Furthermore, the leaf spring 44 on the top surface of the lighting appliance 4 makes contact with the electrodes 56 provided in the guide part 5, thereby short-circuiting the electrodes 56.

The lighting control circuit 23 of the light source 2 drives the semiconductor laser element 21 using the short-circuiting of the electrodes 56 as a trigger signal. The blue laser light emitted from the semiconductor laser element 21 is transmitted to the lighting appliance 4 through the space surrounded by the cover portion 53 of the guide part 5. The blue laser light is reflected by the first reflection portion 46 and the second reflection portion 47 and is incident on the wavelength conversion part 48. Then, the wavelength conversion part 48 converts the blue laser light to white illumination light L. The illumination light L (indicated by a lower arrow in FIG. 3A) is distribution-controlled by the optical member 49 and is emitted to the outside of the lighting appliance 4.

According to the illumination device 1 configured as above, the lighting appliance 4 can be mounted in an arbitrary position of the rail-shaped guide part 5 extending in the transmission direction of the laser light. This enables a user or other person to arbitrarily select the installation position of the lighting appliance 4 which emits illumination light.

Since the laser light emitted from the light source 2 is transmitted to the lighting appliance 4 through the space surrounded by the cover portion 53 of the guide part 5, the lighting appliance 4 can be slidingly moved while transmitting the laser light emitted from the light source 2 to the lighting appliance 4. Thus, the lighting appliance 4 is slidingly movable even under a state in which the lighting appliance 4 is mounted to the guide part 5 and is allowed to emit illumination light. Accordingly, a user or other person can arbitrarily select the installation position of the lighting appliance 4 which emits illumination light, while turning on the lighting appliance 4 in conformity with an object to be illuminated in the installation place of the illumination device 1. Furthermore, the light path of the laser light is surrounded by the cover portion 53. The laser light is reflected by the first reflection portion 46 in the mounting portion 42 and the second reflection portion 47 in the lighting appliance case 41 toward the opening portion 54. Thus, the laser light is invisible in the position just below the guide part 5 and is not leaked to the outside of the guide part 5. This makes it possible to improve the appearance of the illumination device 1.

Furthermore, the shorter side length L1 of the mounting portion 42 corresponds to the width W1 of the opening portion 54, and the longer side length L2 of the mounting portion 42 corresponds to the internal width W2 of the guide part 5. Thus, by inserting the lighting appliance 4 into the opening portion 54 and rotating the lighting appliance 4 by 90 degrees, a user or other person can easily install the lighting appliance 4 in the guide part 5 without having to use an additional tool or the like.

In the lighting appliance 4, the laser light transmitted through the space surrounded by the cover portion 53 can be reflected by the first reflection portion 46 and the second reflection portion 47 in the direction perpendicular to the mounting surface 5B of the guide part 5, whereby the illumination light can be irradiated in the direction perpendicular to the mounting surface 5B through the wavelength conversion part 48. Thus, the illumination device 1 can be suitably used as a spotlight. Moreover, the light source 2 emits laser light when the electrodes 56 of the guide part 5 are short-circuited, namely when the lighting appliance 4 is mounted to the guide part 5. It is therefore possible to prevent laser light from being unnecessarily emitted.

Figure 5:
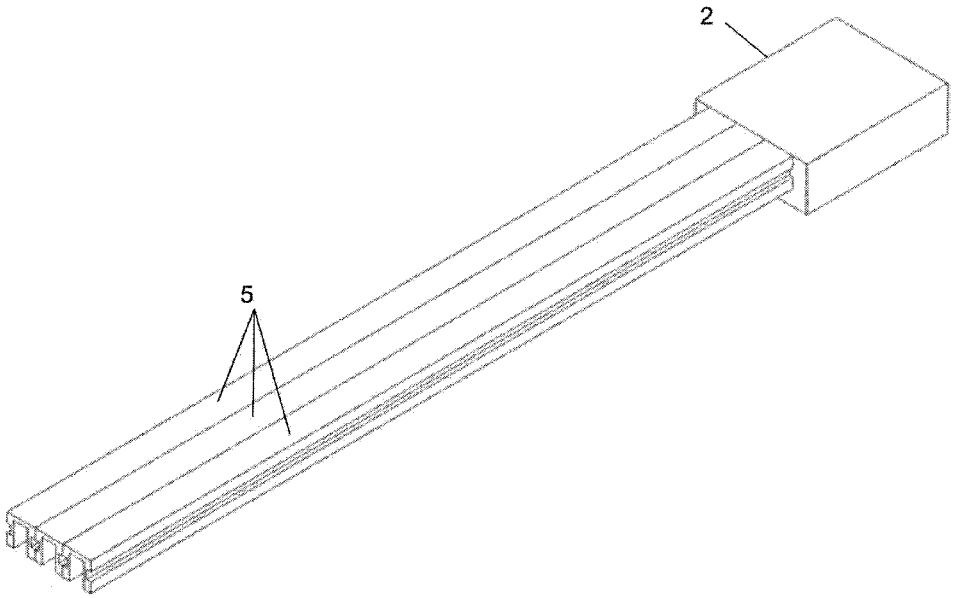
FIG. 5 is a perspective view of an illumination device according to a modification of the aforementioned embodiment.

Next, an illumination device 1 according to a modification of the aforementioned embodiment will be described with reference to FIG. 5. The illumination device 1 according to this modification includes a plurality of guide parts 5 and a plurality of lighting appliances 4. The guide parts 5 are disposed in parallel and the lighting appliances 4 are mounted to the respective guide parts 5. A plurality of semiconductor laser elements 21 (not shown) is provided in the light source 2. Laser light is transmitted from each of the semiconductor laser elements 21 to each of the lighting appliances 4.

According to the illumination device 1 of the aforementioned embodiment, it is possible to arbitrarily select the fixing relationship of the lighting appliance 4 with respect to the light source 2. If the length of the guide parts 5 is sufficient, it is possible to increase the distance between the light source 2 and the lighting appliance 4. Thus, the light source 2 including the heat dissipation part 22 having a specified size can be installed in an inconspicuous position under the installation environment of the illumination device 1. The guide part 5 extends from the light source 2. The lighting appliance 4, which is small and inconspicuous, can be installed near (for example, just above) an object to be illuminated. In the illumination device 1 of the aforementioned embodiment, the light source 2 and the lighting appliance 4 are in a one-to-one correspondence relationship. Therefore, for example, if the installation environment of the illumination device 1 is wide, it may be impossible to illuminate a plurality of objects or a wide range in case where only one lighting appliance 4 is available. In contrast, according to this modification, the use of a plurality of lighting appliances 4 makes it possible to illuminate a plurality of objects or a wide range. By mounting the plurality of lighting appliances 4 to the respective guide parts 5, it is possible to arbitrarily select the installation positions of the respective lighting appliances 4.

The present invention is not limited to the aforementioned embodiment but may be modified in many different forms. For example, the guide part 5 is a rail-shaped member extending in a linear shape. As an alternative example, a plurality of guide parts 5 cut into a predetermined length may be connected at an arbitrary angle. A reflection plate (not shown) which reflects laser light at the arbitrary angle may be provided in the region of the connection portion surrounded by the cover portion 53. By doing so, the laser light is transmitted through the respective guide parts 5 in a parallel relationship with the longitudinal direction of the guide parts 5. Therefore, similar to the aforementioned embodiment, the laser light can be picked up by the first reflection portion 46 and the second reflection portion 47 of the lighting appliance 4. Then, the laser light can be wavelength-converted so as to emit illumination light from the lighting appliance 4.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. An illumination device, comprising:

a light source configured to emit laser light;

a transmission part configured to transmit the laser light emitted from the light source; and a lighting appliance configured to convert a wavelength of the laser light transmitted through the transmission part and to emit illumination light, wherein the transmission part includes a rail-shaped guide part extending in a linear shape along a transmission direction of the laser light, the lighting appliance is configured to be mounted in an arbitrary position of the guide part, the guide part includes a mounting surface on which the lighting appliance is mounted, the mounting surface extending a longitudinal direction of the guide part, the mounting surface includes a cover portion configured to surround a space through which the laser light is transmitted in air and an opening portion opened at a predetermined width along the cover portion, and the lighting appliance is fitted to the opening portion.

2. The device of claim 1, wherein the lighting appliance includes a mounting portion for mounting the lighting appliance to the guide part, the mounting portion having two mutually-orthogonal sides differing in length from each other when viewed in a direction perpendicular to the mounting surface, a shorter side length of the mounting portion corresponding to a width of the opening portion, and a longer side length of the mounting portion corresponding to an internal width of the guide part.

3. The device of claim 2, wherein the lighting appliance includes a first reflection portion configured to reflect the laser light transmitted through a space surrounded by the cover portion in a width direction of the guide part and a second reflection portion configured to reflect the laser light reflected by the first reflection portion in the direction perpendicular to the mounting surface.

4. The device of claim 2, wherein the guide part includes a plurality of guide parts, the lighting appliance includes a plurality of lighting appliances, and each of the lighting appliances is mounted to each of the guide parts through the mounting portion.

5. The device of claim 1, wherein the guide part includes a pair of electrodes extending in a longitudinal direction of the guide part, the lighting appliance includes an electrically conductive member configured to short-circuit the electrodes when the lighting appliance is mounted to the guide part, and the light source is configured to emit the laser light when the electrodes are short-circuited.

6. The device of claim 5, wherein the pair of electrodes extend over the total length of the guide part.

7. The device of claim 1, wherein the lighting appliance further includes a leaf spring provided on a top surface thereof, the guide part further includes a pair of electrodes, and the leaf spring is configured to make contact with the pair of electrodes and short-circuit the electrodes when the lighting appliance is mounted to the guide part.

* * * * *